US011845076B2

(12) United States Patent
Malvoisin

(10) Patent No.: US 11,845,076 B2
(45) Date of Patent: Dec. 19, 2023

(54) SYSTEM FOR EJECTING TIPS OF SAMPLING PIPETTES WITH IMPROVED ERGONOMICS

(71) Applicant: GILSON SAS, Villiers-Lebel (FR)

(72) Inventor: Hervé Malvoisin, Paris (FR)

(73) Assignee: GILSON SAS, Villiers-Lebel (FR)

( * ) Notice: Subject to any disclaimer, the term of this patent is extended or adjusted under 35 U.S.C. 154(b) by 583 days.

(21) Appl. No.: 17/052,324

(22) PCT Filed: May 3, 2019

(86) PCT No.: PCT/FR2019/051023
§ 371 (c)(1),
(2) Date: Nov. 2, 2020

(87) PCT Pub. No.: WO2019/215405
PCT Pub. Date: Nov. 14, 2019

(65) Prior Publication Data

US 2021/0106986 A1 Apr. 15, 2021

(30) Foreign Application Priority Data

May 7, 2018 (FR) ..... 1853943

(51) Int. Cl.
*B01L 3/02* (2006.01)

(52) U.S. Cl.
CPC ..... *B01L 3/0279* (2013.01); *B01L 3/0217* (2013.01); *B01L 2200/087* (2013.01)

(58) Field of Classification Search
CPC ..... B01L 2200/0605; B01L 2200/143; B01L 2200/146; B01L 2200/147; B01L 2300/02;

(Continued)

(56) References Cited

U.S. PATENT DOCUMENTS

2003/0147781 A1 8/2003 Viot
2009/0071267 A1* 3/2009 Mathus ..... B01L 3/0227 422/400

(Continued)

FOREIGN PATENT DOCUMENTS

CN 1422184 A 6/2003
CN 205361387 U 7/2016

(Continued)

OTHER PUBLICATIONS

International Search Report for PCT/FR2019/081023 dated Jun. 27, 2019.

(Continued)

*Primary Examiner* — John Fitzgerald
*Assistant Examiner* — Truong D Phan

(57) ABSTRACT

A system for ejecting tips of sampling pipettes, the system comprising: —a button for ejecting a tip which is intended to be moved in translation by an operator's thumb; —a tip ejection device; and —return spring for returning the tip ejection device to a raised position. According to the invention, the system also comprises a lever for controlling the ejection device, the control lever comprising: —a first end which is intended to be fitted onto a part of the pipette; —a second end cooperating with the eject button so as to be acted upon by the latter; and —an intermediate portion for actuating the ejection device.

13 Claims, 5 Drawing Sheets

(58) Field of Classification Search
CPC ..... B01L 2300/023; B01L 3/0237; B01L 2200/14; B01L 3/02; B01L 3/022; B01L 2200/00; B01L 2300/021; B01L 2300/0627; B01L 2300/0636; B01L 2300/0663; B01L 2300/0861; B01L 2300/12; B01L 2300/123; B01L 2300/14; B01L 2300/18; B01L 2300/1888; B01L 2400/0478; B01L 2200/087; B01L 3/0217; B01L 3/0279; G01N 35/00871; G01N 35/1009; G01N 35/1016
See application file for complete search history.

(56) References Cited

U.S. PATENT DOCUMENTS

2012/0148459 A1 6/2012 Sarna et al.
2014/0298925 A1 10/2014 Voyeux et al.
2018/0250667 A1 9/2018 Dudek et al.

FOREIGN PATENT DOCUMENTS

FR 2980123 A1 3/2013
FR 3040896 A1 3/2017
WO 0176752 A1 10/2001
WO WO-2016030978 A1 * 3/2016 ..... B01L 9/54

OTHER PUBLICATIONS

Written Opinion for PCT/FR2019/081023 dated Jun. 27, 2019.
Search Report for French Application No. FR1853943 dated Oct. 19, 2018.
Office action for Chinese application No. 2019800057496 dated Nov. 15, 2021.
Search Report for Chinese application No. 2019800057496 dated Nov. 5, 2021.

* cited by examiner

SYSTEM FOR EJECTING TIPS OF SAMPLING PIPETTES WITH IMPROVED ERGONOMICS

CROSS-REFERENCE TO RELATED APPLICATIONS

This is a National Stage application of PCT international application PCT/FR2019/051023, filed on May 3, 2019, which claims the priority of French Patent Application No. 1853943, filed May 7, 2018, both of which are incorporated herein by reference in their entirety.

TECHNICAL FIELD

The invention relates the field of sampling pipettes, also called laboratory pipettes or even liquid transfer pipettes, for sampling and dispensing liquids in containers or similar.

The invention related to any type of pipette, whether mechanical, electronic or hybrid, of the single channel or multichannel type.

The pipettes more preferentially concerned by the present invention are manually-actuated mechanical pipettes. These pipettes are to be held in hand by an operator during liquid collection and dispense operations. These operations are made by moving a control knob achieved by applying an actuation pressure on the same knob, via the operator's thumb. As discussed above, the invention can also relate to hybrid pipettes, or even so-called electronic pipettes within which the motion of the piston is generated by a motor receiving a command from the operator, as a result of a pressure exerted on a control knob.

State of Prior Art

One of the functions provided by the pipettes lies in ejecting collection cones. This ejection is usually triggered by the operator which pushes, with his/her thumb, an ejection knob located at an upper part of the pipette, in the proximity of the control knob.

The downward movement of the ejection knob drives therewith the entire ejection system, which, at its lower end, pushes the periphery of a cone press-fitted to the pipette tip, in order to cause its ejection. This ejection requires overcoming frictional forces between the cone and its tip. Hence, the operator may have to put in a substantial effort on the ejection knob to disengage the collection cone.

Even if this solution is wide spread on pipettes known in the state of the art, there is still a need for optimising the ergonomics associated with the ejection function of collection cones.

DISCLOSURE OF THE INVENTION

To at least partially meet the above-identified need, one object of the invention is a cone ejection system for a collection pipette, the system comprising:

- a cone ejection knob for being translationally moved by an operator's thumb;
- a cone ejection device;
- elastic return means capable of returning the cone ejection device into a high position.

According to the invention, the system further comprises a control lever for controlling the ejection device, the control lever including:

- a first end for being mounted onto a piece of the pipette;
- a second end cooperating with said ejection knob, so as to be biased by the same;
- an intermediate portion for actuating the cone ejection device Therefore, the invention provides a simple, efficient and cheap response, improving ejection ergonomics of collection cones. Indeed, by means of the particular use of the control lever, the ejection force to be exerted on the knob turns out to be advantageously lower than that required with solutions of prior art. Consequently, this specificity of reducing the ejection force, via the control lever, provides comfort of use for the operator.

In addition, the solution provided by the invention has the advantage of keeping a linear motion of moving the control knob, which contributes to an overall improvement in ergonomics associated with the cone ejection function. This type of linear movement moreover guarantee the solidity of pipette, since the risks of breakage or damage to the ejection knob turn out to be extremely low.

Additionally, the invention includes at least any of the following optional characteristics, taken alone or in combination.

Preferably, the ejection system is designed in the following way:

- the first end of the control lever is hingedly mounted onto the piece of the pipette;
- the ejection knob is bearing on the second end of the control lever;
- the intermediate portion for actuating the control lever is bearing on the cone ejection device.

In this preferred embodiment, the control lever is thus hinged at its first end, and bearing on the ejection knob as well as on the ejection device. Consequently, during a cone ejection operation, the lever pivots whereas mere bearing points are observed at its contacts with the knob and the ejection device.

Another design could for example consist in providing a pivot connection between the second end of the control lever, and the ejection knob. In such a case covered by the invention, the first end of the lever could then be slidably and pivotably mounted, in a rail of the pipette piece for cooperating with this lever. Similarly, the intermediate portion could be hinged to the cone ejection device, and both ends of the lever simply bearing on the pipette piece and the ejection knob.

Preferably, the connection between the intermediate portion for actuating the control lever, and the cone ejection device, is a sphere-plane point connection. This type of connection enables frictions upon pivoting the control lever to be limited as much as possible. The wear out of the pieces concerned is thereby advantageously reduced. Further, this type of connection enables an always axially oriented force to be transmitted to the ejection device, offering a large efficiency.

The ejection device has a high portion biased by the elastic return means and for being housed in a fixed body forming a handle of the pipette, as well as a low portion integral with the high portion and defining a cone ejection end.

The ejection device is to be translationally movable with respect to the fixed body of the pipette.

Another object of the invention is a collection pipette comprising such a cone ejection system.

Preferably, the piece onto which the first end of the control lever is mounted is secured to the fixed body forming the handle of the pipette, or made as a single piece with this fixed body.

Preferably, the piece onto which the first end of the control lever is mounted is centred on a longitudinal central axis of the pipette, and a control rod of the pipette therethrough.

Preferentially, a pivot axis of the first end of the control lever intersects a longitudinal central axis of the pipette, preferably substantially orthogonally.

The pipette has a stroke-end stop for the ejection knob, said stop being secured to the fixed body forming the handle of the pipette, or made as a single piece with this fixed body. This stop is preferentially made of an elastomeric material.

Preferably, the ejection knob projects upwardly from the fixed body forming the handle of the pipette.

Preferentially, the ejection knob is translationally movable with respect to the fixed body forming the handle of the pipette, preferably in parallel to a longitudinal central axis of the pipette.

Finally, the pipette is preferably a mechanical pipette, but it could be an electronic or hybrid pipette with such a manual collection cone ejection system.

Further advantages and characteristics of the invention will appear in the non-limiting detailed description below.

BRIEF DESCRIPTION OF THE DRAWINGS

This description will be made in relation to the appended drawings in which.

DETAILED DESCRIPTION OF PREFERRED EMBODIMENTS

Figure 1:
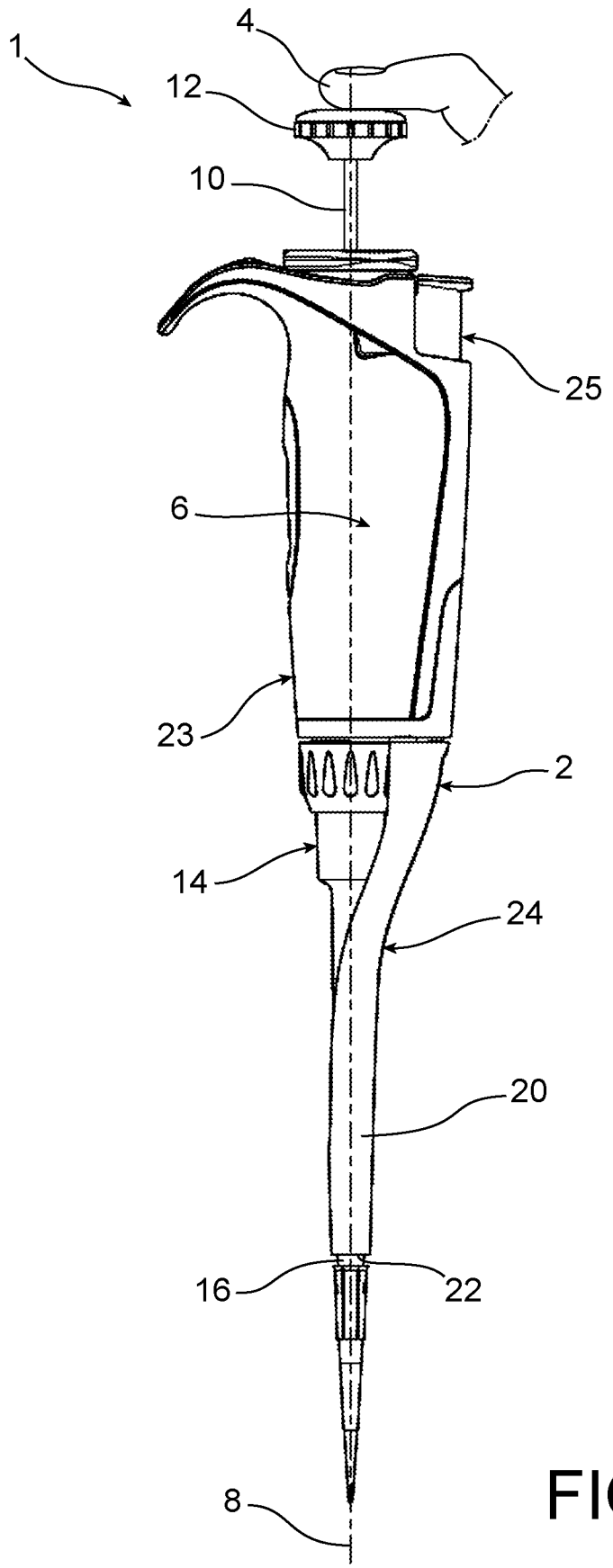
FIG. 1 represents a side view of a collection pipette according to the invention, with its cone ejection system in an inactive idle state.

With reference to FIG. 1, a mechanical collection pipette 1 is represented, comprising a cone ejection system 2 according to the invention. The pipette 1 has a manual actuation design, that is it is to be held by an operator's hand, which, using his/her thumb 4, is apt to actuate the pipette to cause a liquid which has been sucked beforehand to be dispensed.

More precisely, the pipette 1 comprises in an upper part, a fixed body forming a handle 6 of the pipette, from which handle a control rod 10 opens. At the high end of this rod 10, the pipette includes a pipetting control knob 12 the upper part of which is to undergo the pressure of the operator's thumb 4.

Under the handle 6, the pipette 1 includes a removable low part 14, which ends downwardly with a cone holder tip 16 receiving a consumable 18, also called a collection cone. The cone ejection system 2 includes an ejection device 24, a low portion 20 of which projecting from the handle 6 defines a cone ejection end 22, surrounding the tip 16. This ejection end 22 faces the high end of the cone 18, so as to cause its disengagement by pushing its periphery.

The ejection device 24, only the low portion 20 of which is visible in FIG. 1, is shown translationally movable with respect to the handle 6 and to the low part 14, both forming the fixed part 23 of the pipette. This is a translation along a direction parallel to a longitudinal central axis 8 of the pipette, along which the control rod 10 is also translationally movable within the pipette. The control rod 10 is additionally centred on this axis 8.

The ejection system 2 additionally includes a cone ejection knob 25, also controlled by the operator's thumb 4. The ejection knob 25 is arranged projecting upwardly at the high end of the handle 6, by being laterally and axially offset from the control knob 12. The ejection knob 25 is translationally movably mounted with respect to the handle 6, also parallel to the direction of the longitudinal central axis 8 of the pipette.

Figure 2:
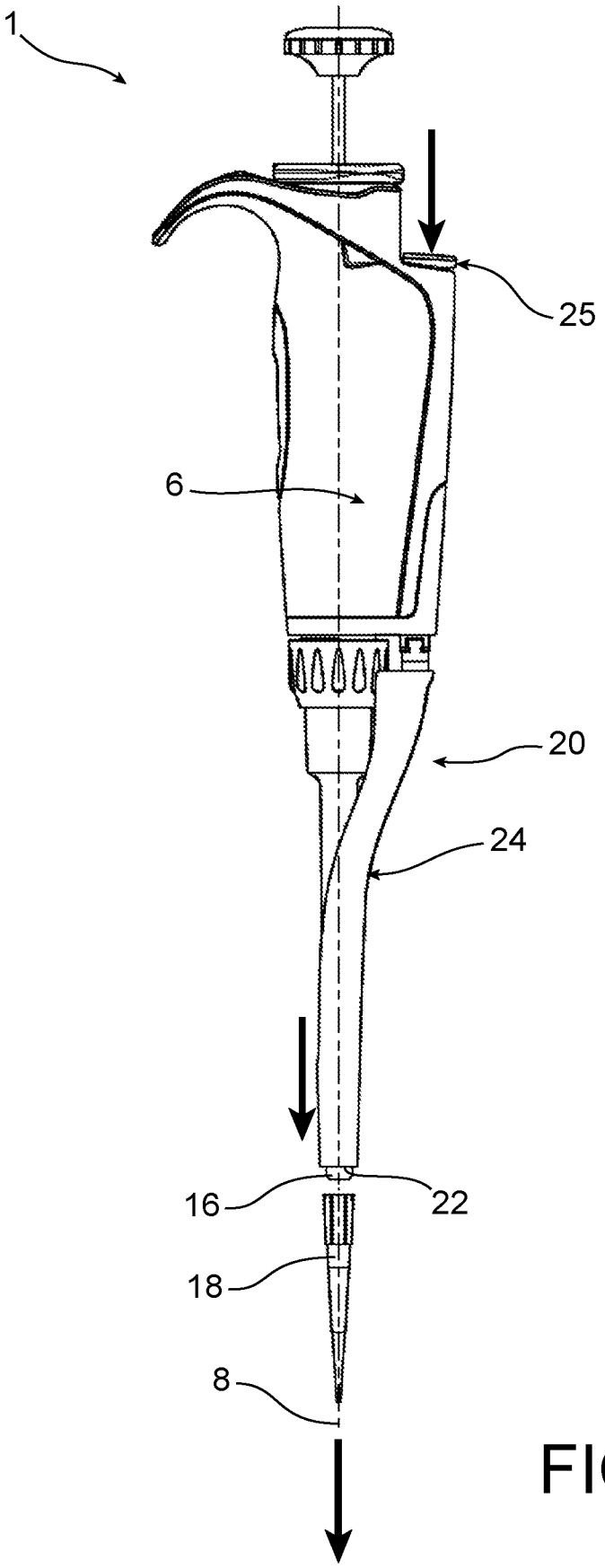
FIG. 2 is a view similar to the previous one, with the cone ejection system in an ejection state.

Thus, when the ejection knob 25 is actuated downwardly by the operator's thumb as depicted in FIG. 2, this knob causes the ejection device 24 to go down, in a specific manner to the invention which will be described hereinafter. The movement of the low portion 20 of the device 24 causes a translation of its ejection end 22 along the tip 16, which results in pushing the cone 18 which then quickly disengages from this tip. In this regard, it is noted that in the embodiment described and represented in the figures, it is a mono-channel pipette carrying a single consumable 18. However, it could be a multi-channel pipette carrying several cones, without departing from the scope of the invention.

Figure 3:
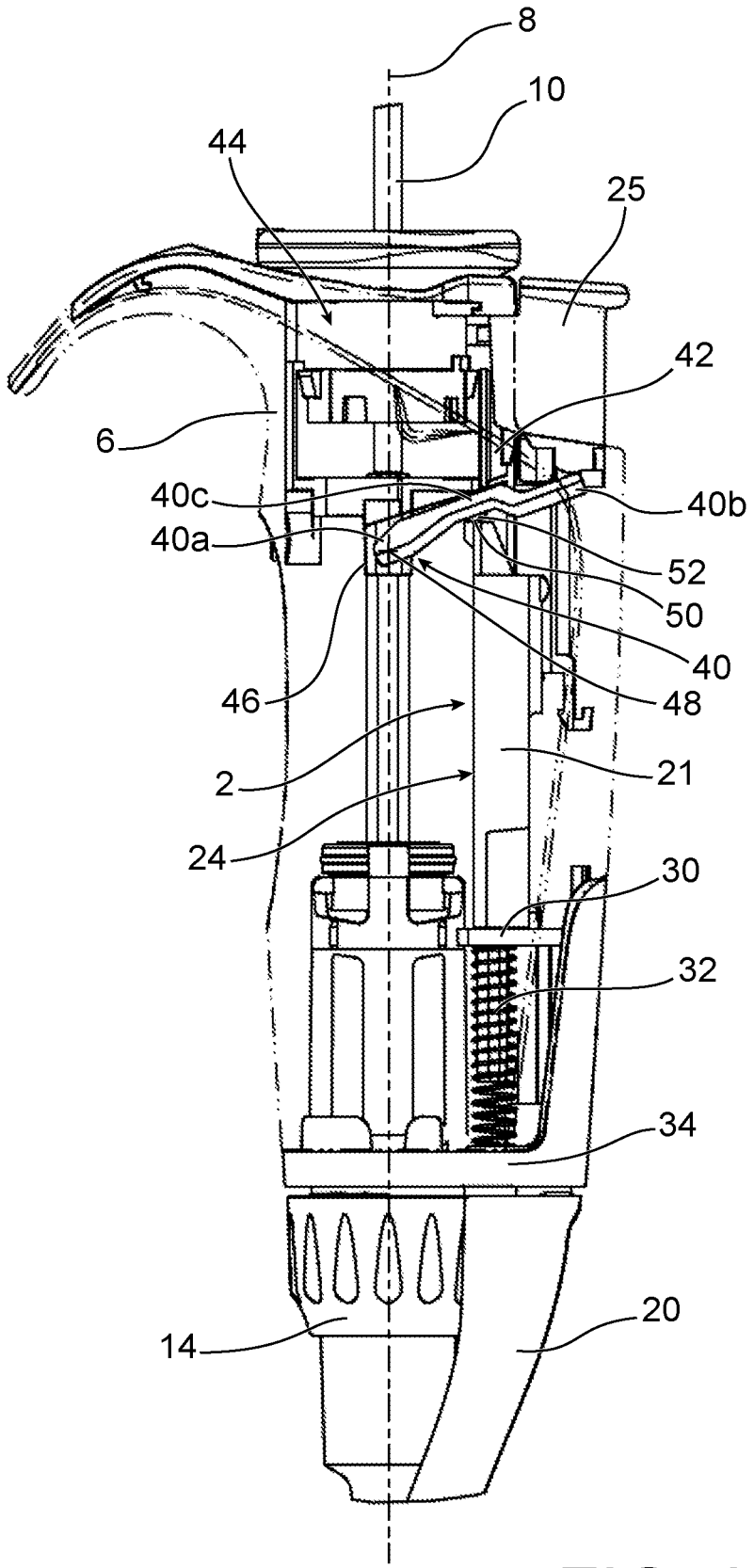
FIG. 3 represents a more detailed view of the cone ejection system, with its knob in an inactive idle position.
Figure 4:
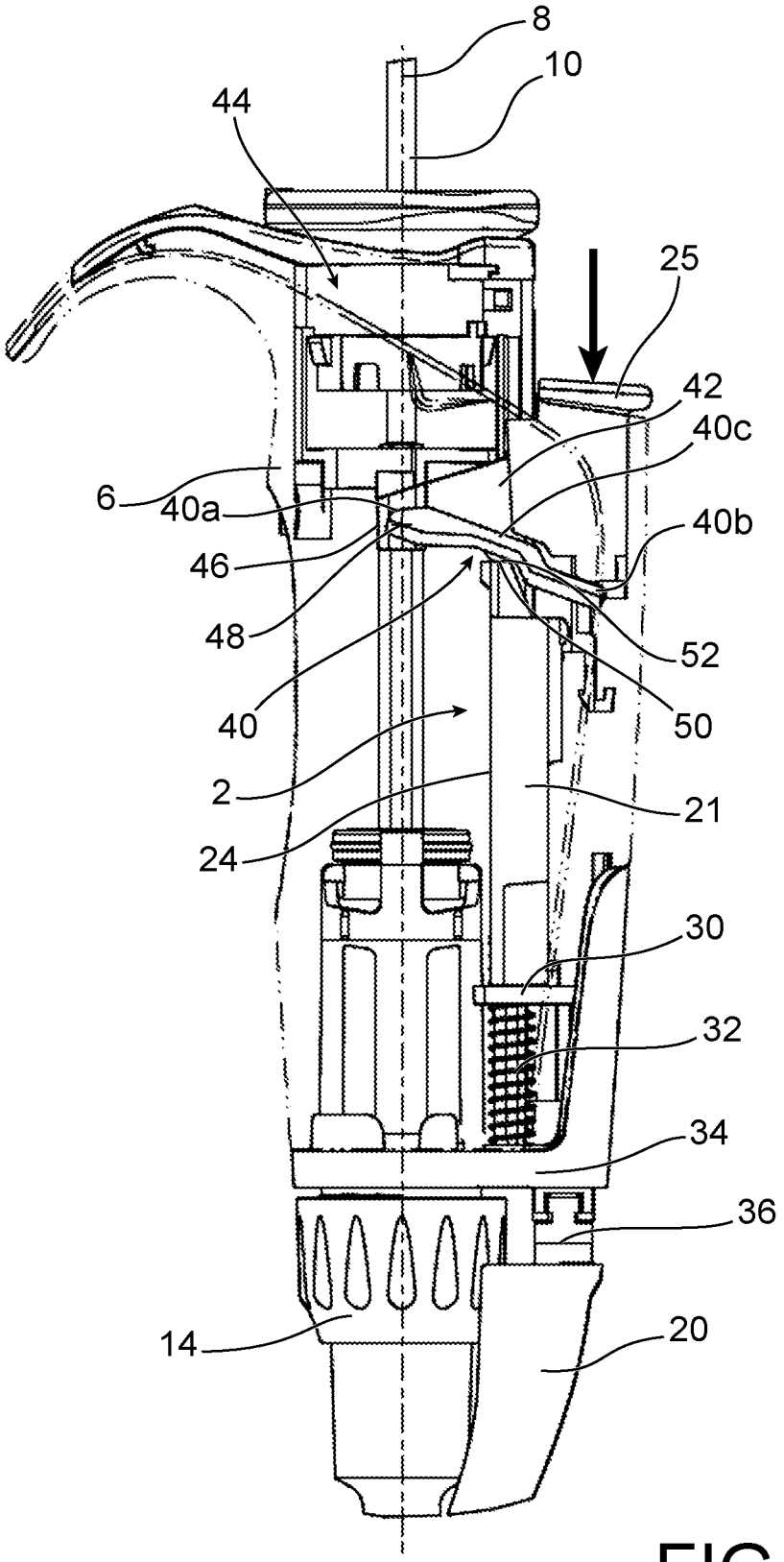
FIG. 4 is a view similar to the previous one, with the knob in a cone ejection position.

With reference now to FIGS. 3 and 4, the ejection system 2 is represented in a more detailed way. FIG. 3 represents the system in an inactive idle state, whereas FIG. 4 represents the same system in a cone ejection state, as a result of an action of the operator on the ejection knob 25.

In these figures, it is first noted that the ejection knob 25 is movably mounted on a guide rail 42 of a fixed assembly 44, formed as a single piece with the handle 6, or secured to this handle by being fixedly mounted thereto.

In addition to the low portion 14, the ejection device 24 also includes a high portion 21 which is housed in the handle 6. The low end of the high portion has a support plate 30 which elastic return means, as a compression spring 32, push. The other end of the spring pushes a fixed piece 34 of the pipette arranged in the proximity of the junction between the handle and the low part 14, so as to return the entire device 24 into the high position. Indeed, the low and high portions 20, 21 of the device 24 are integral with each other, and connected by a rod 36 visible in FIG. 4, which passes through the fixed piece 34.

One of the features of the invention lies in the presence of a force reducing element within the ejection system 2, namely a control lever 40. This lever 40 is interposed between the ejection knob 25, and the high portion 21 of the device 24 it controls. It first includes a first end **40*a* hingedly mounted onto a fixed piece 46 of the abovementioned assembly 44. This fixed piece 46 is centred on the longitudinal central axis 8, and takes the form of a sleeve through which the control rod 10 passes. The pivot axis 48 of the first end 40*a* orthogonally intersects the longitudinal central axis 8, and it is located offset downwardly from the ejection knob 25, when the same occupies its inactive idle position of FIG. 3**.

The first end **40*a* can be formed by a single hinged branch, or take the form of a clevis the two lugs of which would be each hinged along the same axis 48 to the fixed piece 46. In the latter case, both clevis lugs would be arranged on either side of the fixed piece 46**, which is received between both lugs.

The lever 40 has, opposite to the first end 40*a*, a second end 40*b* on which the low end of the ejection knob 25 is bearing. It can be a sphere-plane or cylinder-plane type connection, in order to limit friction and wear resulting therefrom when the lever 40 pivots.

Finally, the lever 40 also includes an actuating intermediate portion 40*c*, arranged between both ends 40*a*, 40*b*, preferably by being substantially centred relative to the same. This intermediate portion 40*c* is provided to translationally actuate the high portion 21 of the device 24, by pushing on the high end of this portion 21. To do this, a sphere-plane point connection 50 is provided between this intermediate portion 40*c* and the high portion 21, for example by providing a spherical cap 52 within the portion 40*c* of the control lever. Further, this connection type enables an always axially oriented ejection force to be transmitted to the high portion 21, offering a large efficiency.

Alternatively, still to limit wear of the pieces in presence, the spherical cap can be provided on the high end of the high portion 21 of the ejection device 24.

When the system 2 is in its in active idle state of FIG. 3, the second end 40*b* is located higher than the first end 40*a*. As the knob 25 is actuated downwardly, the second end 40*b* it pushes is moved downwardly, and causes the lever 40 to be rotated about the pivot axis 48. In this rotation, during which the lever 40 passes through a median position in which it is oriented substantially orthogonally to the longitudinal central axis 8, the intermediate portion 40*c* pushes on the high portion 21 and drives the entire ejection device 24 downwardly. This rotation of the lever 40 continues until the system 2 assumes its ejection state of FIG. 4, in which the second end 40*b* is located lower than the first end 40*a*.

Figure 5:
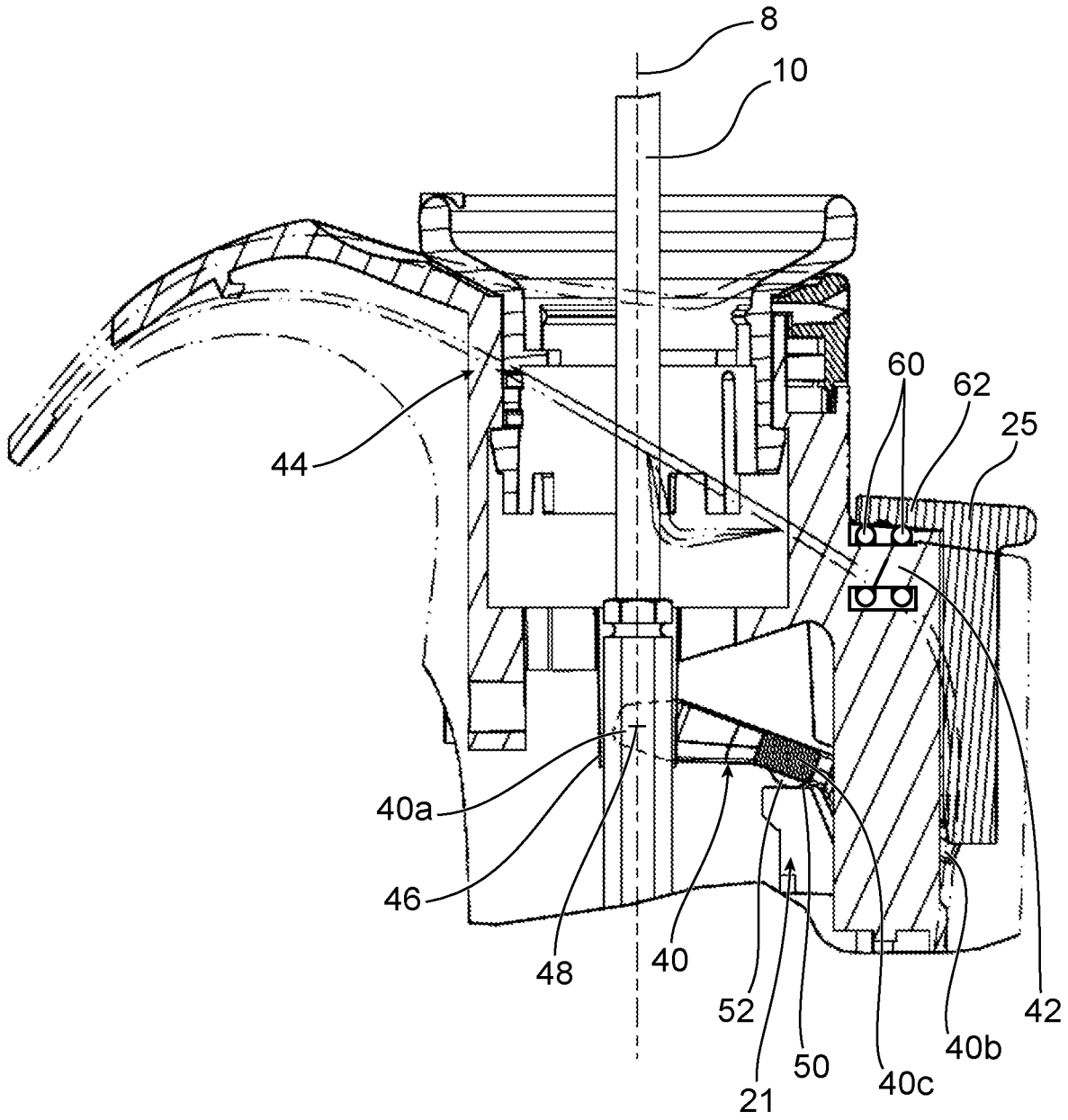
FIG. 5 is an enlarged partial view of the one of FIG. 4, showing more particularly the stroke-end stop associated with the ejection knob.

This ejection position is not marked with a stroke-end stop associated with the lever, but by a stroke-end stop of the ejection knob 25, so as to limit risks of damage to this lever 40. The stop herein takes the form of one or more seals 60 of elastomeric material, represented in FIG. 5. These seals 60 are carried by the guide rail 42, at a high end thereof, in order to be contacted with a high end 62 of the knob forming the pressure zone for the operator. Thus, at the end of an ejection operation, the operator pushing with his/her thumb on the pressure zone 62 is halted in his/her motion by the stop of the same zone 62 on the seals of elastomeric material 60.

The stroke of the ejection knob 25 between its two end positions is for example in the order of 10 to 20 mm, whereas the incident stroke of the ejection device 24 is in the order of half that of the knob 25.

Of course, various modifications can be provided by those skilled in the art to the invention just described, only by way of non-limiting examples, and the scope of which is defined by the appended claims.

What is claimed is:

1. A collection pipette comprising a cone ejection system, the cone ejection system comprising:

a cone ejection knob for being translationally moved by an operator's thumb;

a cone ejection device;

elastic return means capable of returning the cone ejection device into a high position; and a control lever for controlling the cone ejection device, the control lever including:

a first end for being mounted onto a piece of the pipette;

a second end cooperating with said cone ejection knob, so as to be biased by the cone ejection knob;

an intermediate portion for actuating the cone ejection device, wherein a pivot axis of the first end of the control lever intersects a longitudinal central axis of the pipette substantially orthogonally, and wherein the control lever is in contact with the cone ejection device from an inactive position of the cone ejection knob to an ejection position of the cone ejection knob.

2. The collection pipette according to claim 1, wherein:

the first end of the control lever is hingedly mounted onto the piece of the pipette;

the ejection knob is bearing on the second end of the control lever;

the intermediate portion for actuating the control lever is bearing on the cone ejection device.

3. The collection pipette according to claim 1, wherein connection between the intermediate portion for actuating the control lever, and the cone ejection device, is a sphere-plane point connection.

4. The collection pipette according to claim 1, wherein the cone ejection device has a high portion biased by the elastic return means and for being housed in a fixed body forming a handle of the pipette, as well as a low portion integral with the high portion and defining a cone ejection end.

5. The collection pipette according to claim 4, wherein the cone ejection device is to be translationally movable with respect to the fixed body of the pipette.

6. The collection pipette according to claim 1, wherein the piece onto which the first end of the control lever is mounted is secured to a fixed body forming a handle of the pipette, or made as a single piece with this fixed body.

7. The collection pipette according to claim 1, wherein the piece onto which the first end of the control lever is mounted is centered on a longitudinal central axis of the pipette, and has a control rod of the pipette therethrough.

8. The collection pipette according to claim 1, further comprising a limit stop for the cone ejection knob, said stop being secured to a fixed body forming a handle of the pipette, or made as a single piece with this fixed body.

9. The collection pipette according to claim 8, wherein the stop is made of an elastomeric material.

10. The collection pipette according to claim 1, wherein the cone ejection knob projects upwardly from a fixed body forming a handle of the pipette.

11. The collection pipette according to claim 1, wherein the cone ejection knob is translationally movable with respect to a fixed body forming a handle of the pipette.

12. The collection pipette according to claim 11, wherein the cone ejection knob is translationally movable in parallel to a longitudinal central axis of the pipette.

13. The collection pipette according to claim 1, wherein the pipette is a mechanical pipette.

* * * * *